US005599430A

United States Patent [19]

Pimlott et al.

[11] Patent Number: 5,599,430

[45] Date of Patent: Feb. 4, 1997

[54] MATTRESS FOR ELECTROCHEMICAL CELLS

[75] Inventors: John R. Pimlott, Sweeny; Richard N. Beaver, deceased, late of Angleton, by Wanda G. Beaver, legal representative; Harry S. Burney, Richwood, all of Tex.

[73] Assignee: The Dow Chemical Company, Midland, Mich.

[21] Appl. No.: 693,851

[22] Filed: Dec. 24, 1992

Related U.S. Application Data

[63] Continuation of Ser. No. 820,726, Jan. 14, 1992, abandoned.

[51] Int. Cl.[6] ..... C25B 9/00; C25B 9/04

[52] U.S. Cl. ..... 204/252; 204/254; 204/279

[58] Field of Search ..... 204/252, 258, 204/263–266, 279, 295, 282–283

[56] References Cited

U.S. PATENT DOCUMENTS

| | | | |
|---|---|---|---|
| 4,444,463 | 4/1984 | deNora | 204/98 |
| 4,568,434 | 2/1986 | Morris et al. | 204/282 X |
| 4,604,171 | 8/1986 | Morris et al. | 204/254 X |
| 4,666,579 | 5/1987 | Beaver et al. | 204/283 X |
| 4,668,371 | 5/1987 | Pimott et al. | 204/253 |

*Primary Examiner*—Donald R. Valentine

[57] ABSTRACT

A pressurized or forced circulation electrolysis cell comprising a cell housing containing at least one pair of electrodes which is a cathode and an anode, a current collector and an ion exchange membrane having a surface area of at least about 40 $ft^2$ having the improvement which comprises an electrically conductive, hydraulically permeable resilient mattress substantially coplanar with and contacting on one side the current collector and coplanar with and contacting on the other side an electrode. The mattress comprises at least six non-aligned layers of woven and crimped metal fibers having a resiliency product of greater than 100 $(inches)^2$/psi according to the formula:

$$RP=10{,}000\times NS\times CH$$

wherein RP represents the resiliency product in $(inches)^2$/psi, NS is the negative slope of the mattress height versus compressive load of the mattress, and CH is the compressive height over the range that the mattress will be compressed in millimeters.

16 Claims, 4 Drawing Sheets

MATTRESS FOR ELECTROCHEMICAL CELLS

This is a continuation of application Ser. No. 830,726, filed Jan. 14, 1992, now abandoned.

FIELD OF THE INVENTION

The present invention relates to an improvement in pressurized or forced circulation electrochemical cells containing ion exchange membranes or diaphragms. More particularly, the invention is concerned with improved mats or mattresses for narrow gap and zero gap electrochemical cells which are pressurized or use forced circulation of fluids. Usually these cells utilize membranes having a surface area of greater than 40 square feet or more.

BACKGROUND OF THE INVENTION

The generation of chlorine or other halogens by electrolysis of an aqueous halide such as hydrochloric acid and/or alkali metal chloride or other corresponding electrolysable halide has been known for a long time. Such electrolysis is usually in a cell in which the anode and the cathode are separated by an ion permeable membrane or diaphragm. In cells having a liquid permeable diaphragm, the alkali metal chloride is circulated through the anolyte chamber and a portion thereof flows through the diaphragm into the catholyte. When alkali metal chloride is electrolyzed, chlorine is evolved at the anode and alkali which may be alkali metal carbonate or bicarbonate, but is more commonly an alkali metal hydroxide solution, is formed at the cathode.

This alkali solution also contains an alkali metal chloride which must be separated from the alkali in a subsequent operation. The alkali solution is relatively dilute, rarely in excess of 12–15% alkali by weight, and since commercial concentrations of sodium hydroxide are normally about 50% or higher by weight, the water in the dilute solution has to be evaporated to achieve this concentration.

When a separator such as an ion exchange membrane is used in a cell to electrolyze a sodium chloride brine, the electrochemical products will normally be gaseous chlorine and an aqueous solution containing sodium hydroxide. The use of a substantially liquid impermeable cation exchange membrane has become the preferred membrane where, for example, a high purity, a lower sodium chloride content, high sodium hydroxide product is desired. It has been found to be more convenient to fabricate ion exchange type electrochemical cells from relatively flat or planar sheets for ion exchange membrane, such as disclosed in U.S. Pat. No. 4,668,371, rather than to interweave the membrane between the anode and cathode within the older finger-like cells used with asbestos diaphragms.

In narrow gap or zero gap electrolysis, the passage of current from one electrode to an opposite electrode takes place only through the ionically-permeable separator, which is the ionic selective and ionic conductive membrane. Current flows from the surface of one separator to the surface of the separator of an adjoining cell only by electronic conductivity (i.e., by the current feeder grids and their associated connections or bipolar separators), then flows ionically to the opposite surface of the separator.

One of the problems which is encountered with these narrow gap or zero gap cells is overcompression which physically damages the membrane. U.S. Pat. Nos. 4,444,632 and 4,693,797 disclose the use of mattresses for overcoming some of the problems resulting from overcompression.

However, the prior art does not provide a means for selecting a mattress material for use in large cells and mattresses that compensates for dimensional tolerances of the electrode to electrode spacing of filter press cells. The teachings of small cells (generally having a membrane area of about 12 to 18 sq. ft.) cannot be used effectively for selecting mattresses for large cells.

The essential requirements for a mattress in narrow gap or zero gap cells is to 1) provide sufficient resiliency or springiness so as to maintain all of the components in the cell in uniform compression, 2) conduct the electrical current from the electrode current collector to the electrode, 3) accomplish 1) and 2) so as to achieve a voltage improvement without damage to the membrane and, 4) be self adjusting so as to obtain good and uniform contact distribution over the entire surface of the electrode.

U.S. Pat. No. 4,444,632 discloses a typical small non-pressurized electrolysis cell comprising a cell housing containing at least one set of gas and electrolyte permeable electrodes respectively, an anode and a cathode separated by an ion permeable diaphragm or membrane, at least one of the electrodes is pressed against the diaphragm or membrane by a mattress comprising an open structure resiliently compressible layer co-extensive with the electrode surface. The mattress is compressible against the membrane while exerting an elastic reaction force onto the electrode in contact with the membrane at a plurality of evenly distributed contact points. This patent is incorporated herein by reference for the purpose of the desirability of the mattress and the narrow gap cell that is illustrated. However, it is understood that it is not possible to extrapolate all the teachings from non-pressurized systems and use them for large pressurized cells such as found in this invention.

U.S. Pat. Nos. 4,545,886 and 4,668,371, which are herein incorporated by reference disclose zero gap cells of the type utilized in the invention in which at least one electrode is in physical contact with an ion exchange membrane but is not embedded into or bonded to the membrane.

U.S. Pat. No. 4,448,662, which is incorporated herein by reference, discloses solid polymer chlor alkali cells containing a cation selective permionic membrane with the anodic electrocatalyst bearing on the anodic surface of the membrane which contains no electrolyte gap between the electrocatalyst bearing on the permionic membrane. The mattress of the present invention can be incorporated in the type of cell disclosed.

It is an object of the present invention to overcome the problem of overcompression of the ion exchange membrane in narrow gap and zero gap electrolysis cells which use a forced circulation of fluid that creates a pressure within the cells.

It is a further object of the invention to provide a means for selecting a mattress for large size electrolysis cells with membranes of at least about 40 $ft^2$ that compensates for the dimensional tolerances of the electrode to electrode spacing of filter press cells.

It is a yet still further object of the invention to provide a mattress for large size electrolysis cells with sufficient resiliency to maintain all of the components in a zero gap cell in compression.

It is a yet another object of the invention to provide a mattress for large size electrolysis cells which utilize a pressurized system or a forced circulation of the anolyte and/or catholyte fluids.

It is also another object of the invention to provide as close a contact as possible of the electrodes with an intermediate membrane or diaphragm in a manner such that the membrane or diaphragm is not damaged due to excessive contact pressure.

SUMMARY OF THE INVENTION

The novel electrolysis cell of the invention operates under a pressurized system or uses forced circulation of fluid and is comprised of a cell housing containing at least a pair of oppositely charged electrodes, namely, a cathode and an anode, and separator which is an ion exchange membrane or diaphragm. At least one of the electrodes comprises an electronically charged electroconductive element, screen or plate spaced from the membrane or diaphragm by a resilient compressible mattress or mat which, when compressed, distributes pressure laterally along the membrane or diaphragm. A current collector is provided coplanar with and in contact with the mattress on one side and in contact with the electrode on the other side.

The ion exchange membrane or diaphragm in such a system is usually more than about 40 square feet in area, preferably about 60 square feet or more. The pressure within the cells is generally about 15–20 psi.

The mattress comprises at least six non-aligned layers of an electrically conductive, hydraulically permeable resilient layers of woven and crimped metal fibers which entirely covers the surface of the separator. The mattress is further characterized by having a resiliency product (RP) of greater than 100 $in^2$/psi according to the formula:

$$RP=10{,}000\times NS\times CH$$

wherein RP represents the resiliency product in $(inches)^2$/psi, NS is the computed negative slope of the mattress versus pounds per square inch of compressive load, and CH is the compressive height over the range that the mattress will be compressed in millimeters.

Advantageously, the layers of the mattress are provided with an alternating crimp pattern to avoid alignment of the crimps. The mattress is formed with at least six layers, preferably about 6 to 12 layers.

A crimp height of about ⅛ to ¼ inch is preferred for the mattress layers with about 3 to 7 crimp per inch for use in large cells.

The layers are formed from electrically conductive metal fibers, for example, nickel, iron, cobalt, molybdenum, lead, or alloys thereof, having a thickness in diameter of about 0.004 to 0.080 inches.

There may be included as one of the layers of the mattress a structure of coiled fibers, that is, a layer can consist of a series of helicoidal cylindrical spirals of wire whose cords are mutually wound with one of the adjacent spirals in an intermeshed or interlooped relationship. The diameter of the spirals is 5 to 10 or more times the diameter of the wire of the spirals. However, such a layer should not be adjacent the membrane because of the possibility of a lack of uniformity of pressure. Some coils or wire loops, because of irregularities on the planarity or parallelism of the surface compressing the membrane, may be subjected to a compressive force greater than that acting on adjacent areas.

When compressed against the membrane, a voltage which is lower by 5 to 150 millivolts can be achieved at the same current flow than can be achieved when the mat simply touches the membrane. This can represent a substantial reduction in kilowatt hour consumption per ton of chlorine evolved.

Preferably, the mattress is compressed to about 80 to 30 percent of its original uncompressed thickness under a compression pressure which is between 50 and 2000 grams per square centimeter of projected area. Even in its compressed state, the mattress must be highly porous and the ratio between the voids volume and the apparent volume of the compressed mattress, expressed in percentage, is advantageously at least 75% and preferably is comprised between 85% and 96%.

The method of the invention of generating halogen in a zero gap cell comprises electrolyzing an aqueous halide containing electrolyte at an anode separated from a cathode by an ion-permeable diaphragm or membrane and an aqueous electrolyte at the cathode, at least one of said anode and cathode having a gas and electrolyte permeable surface held in direct contact with the diaphragm or membrane by an electroconductive, resiliently compressible mattress of the invention open to electrolyte and gas flow and capable of applying pressure to the said surface and distributing pressure laterally whereby the pressure on the surface of the diaphragm or membrane is uniform.

Other objects and a fuller understanding of the invention will be had by referring to the following description and claims taken in conjunction with the accompanying drawings.

DESCRIPTION OF THE PREFERRED EMBODIMENTS

Figure 1:
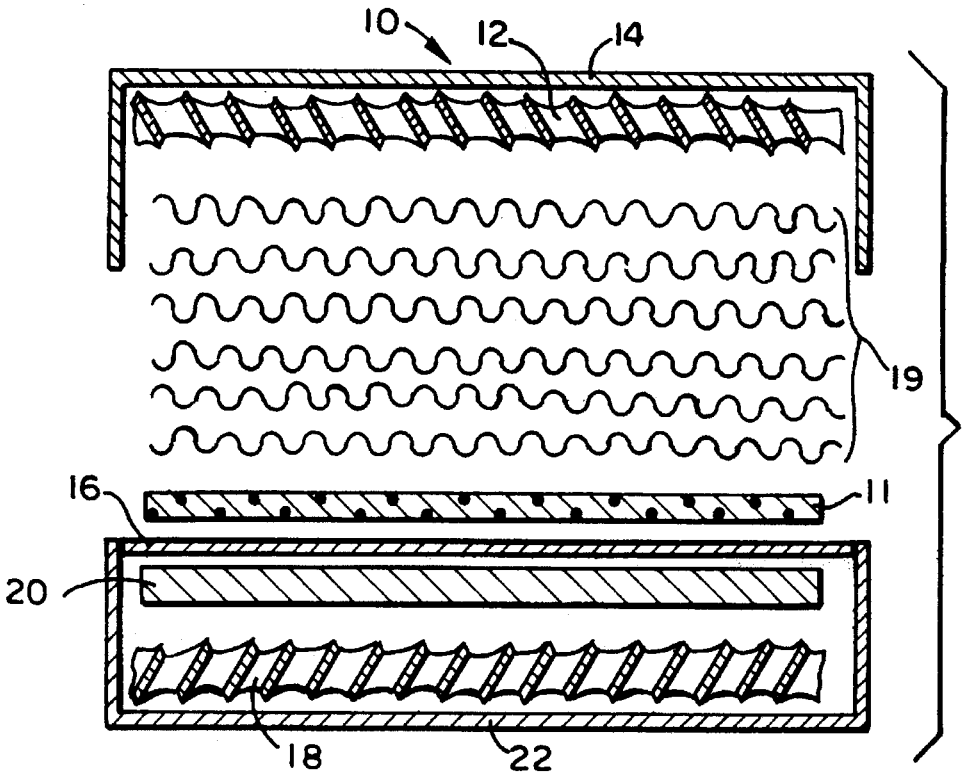
FIG. 1 is an exploded sectional horizontal view of a cell of the invention having a typical compressible electrode system of the type herein contemplated with a multilayered compressible mattress.

Although specific terms are used in the following description for the sake of clarity, these terms are intended to refer only to the particular structure of the invention selected for illustration in the drawings, and are not intended to define or limit the scope of the invention.

Figure 2:
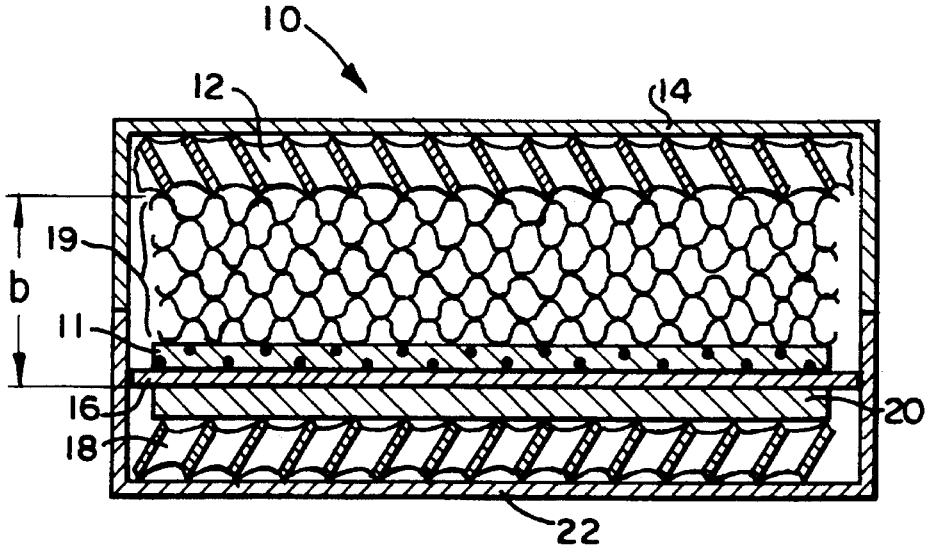
FIG. 2 is a sectional view of the assembled cell of FIG. 1.

Referring to FIGS. 1 and 2, there is shown a typical forced circulation electrolysis cell 10 which is particularly useful in the electrolysis of sodium chloride brine. The cell 10 comprises a cathodic end-plate 14 which is adjacent to a cathode 12 that contacts the mattress 19 of the invention. The mattress 19 abuts a current collector 11 which is preferably in the form of a woven screen or expanded metal sheet or louvered sheet. The preferred cells of the invention are those employing a membrane separator 16 of about 5'×12' and utilizing a forced circulation of fluids which creates a pressure.

The separator 16 is preferably an ion-exchange membrane, fluid-impervious and cation-permselective, such as a membrane consisting of a 0.3 mm-thick polymeric film of a copolymer of tetrafluoroethylene and perfluorosulfonylethoxyvinylether having ion exchange groups such as sulfonic, carboxylic or sulfonamide groups. Because of its thinness, it is relatively flexible and tends to sag, creep, or otherwise deflect unless supported. Such membranes are produced by E.I. Du Pont de Nemours under the trademark of "Nafion." The membranes are flexible ion exchange polymers capable of transporting ions. Normally, they have been heated in an aqueous electrolyte such as acid or alkali metal hydroxide and thereby become highly hydrated, thus containing a considerable amount, 10–15% or more by weight of water either combined as hydrate or simply absorbed.

On the anodic side of the membrane 16 there is the anode 18 which is separated from the membrane 16 by a current collector 20. An end-plate 22 adjacent the anode 18 is clamped together with cathode end-plate 14 during cell operation so as to provide compression of the mattress 19.

The anodic end-plate 22 can be made of steel with its side contacting the anolyte cladded with titanium or another passivatable valve metal or it can be graphite or moldable mixtures of graphite and a chemically inert polymer, such as polytetrafluoroethylene, and the like.

The cathodic end-plate 14 can be made of steel or other conductive metal resistant to hydrogen and caustic.

The anodic end-plate 22 and the cathodic end-plate 14 are both properly connected to an external current source.

The anode 20 preferably consists of a gas and electrolyte permeable titanium, niobium or other valve metal woven screen or expanded sheet coated with a non-passivatable and electrolysis-resistant material such as noble metals and/or oxides and mixed oxides of platinum group metals or an other electrocatalytic coating which serve as an anodic Surface when placed on a conductive substrate. The anode 18 is preferably a substantially rigid and the screen is sufficiently thick to carry the electrolysis current from the end-plate 22 without excessive ohmic losses. Preferably, a fine mesh screen which can be of the same material as the coarse screen is disposed on the surface of the coarse screen to provide fine contacts with the membrane 16. The fine mesh is preferably coated with noble metals or conductive oxides such as noble metal oxides which are resistant to the anolyte.

The cathode screen 11 conveniently may be a woven nickel wire or other convenient material capable of resisting corrosion under cathodic conditions. While it can have some rigidity, it preferably should be flexible and essentially non-rigid so that it can readily bend to accommodate the irregularities of the membrane cathodic surface. These irregularities can be in the membrane surface itself but more commonly are due to irregularities in the more rigid anode against which the membrane 20 bears.

Preferably the screen 11 is coated with a catalytic material suitable for hydrogen production in strong caustic. Such catalytic materials include nickel oxide and the oxides of platinum group metals, preferably ruthenium dioxide.

For most purposes, the mesh size of the screen 11 should be smaller than the size of the openings between the crimps of the mattress 19. Screens with openings of 0.5 to 3 millimeters in width and length are suitable although the finer mesh screens are particularly preferred according to the preferred embodiment of the invention.

The intervening screen can serve a plurality of functions. First, since it is electroconductive it presents an active electrode surface. Second, it serves to prevent the mattress 19 from locally abrading, penetrating or thinning out the membrane. Thus, as the compressed mattress 19 is pressed against the screen in a local area, the screen helps to distribute the pressure along the membrane surface between adjacent pressure points and also prevents a distorted crimp section from penetrating or abrading the membrane.

Compression of the mattress 19 is found to effectively reduce the overall voltage required to sustain a current flow of 1000 Amperes per square meter or more of active membrane surface. At the same time, compression should be limited so that the compressible mattress remains open to electrolyte and gas flow. Furthermore, the spaces between crimps should remain spaced to permit access of catholyte to the membrane and the sides of the crimps.

During the cell operation, the anolyte consisting, for example, of a saturated sodium chlorine brine is caused to be circulated through the anode chamber, more desirably feeding fresh anolyte through an inlet pipe (not illustrated) in the vicinity of the chamber bottom and discharging the spent anolyte through an outlet pipe (not illustrated) in the proximity of the top of the chamber together with the evolved chlorine. The cathode chamber is fed with water or dilute aqueous caustic through an inlet pipe (not illustrated) at the bottom of the chamber, while the alkali produced is recovered as a concentrated solution through an outlet pipe (not illustrated) in the upper end of the cathode chamber. The hydrogen evolved at the cathode can be recovered from the cathode chamber, either together with the concentrated caustic solution or through another outlet pipe at the top of the chamber.

Figure 3:
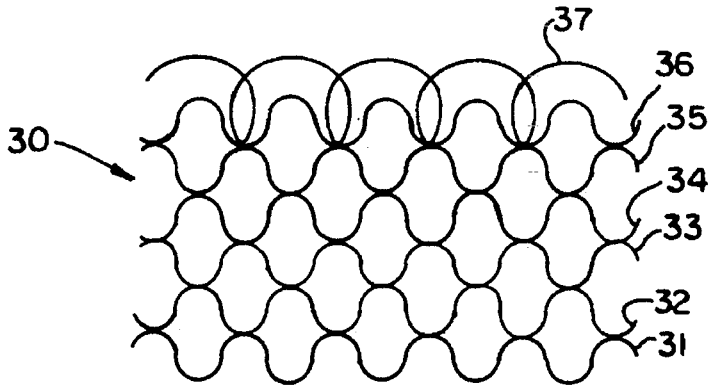
FIG. 3 illustrates a multilayered crimped mattress with a coiled layer.
Figure 4:
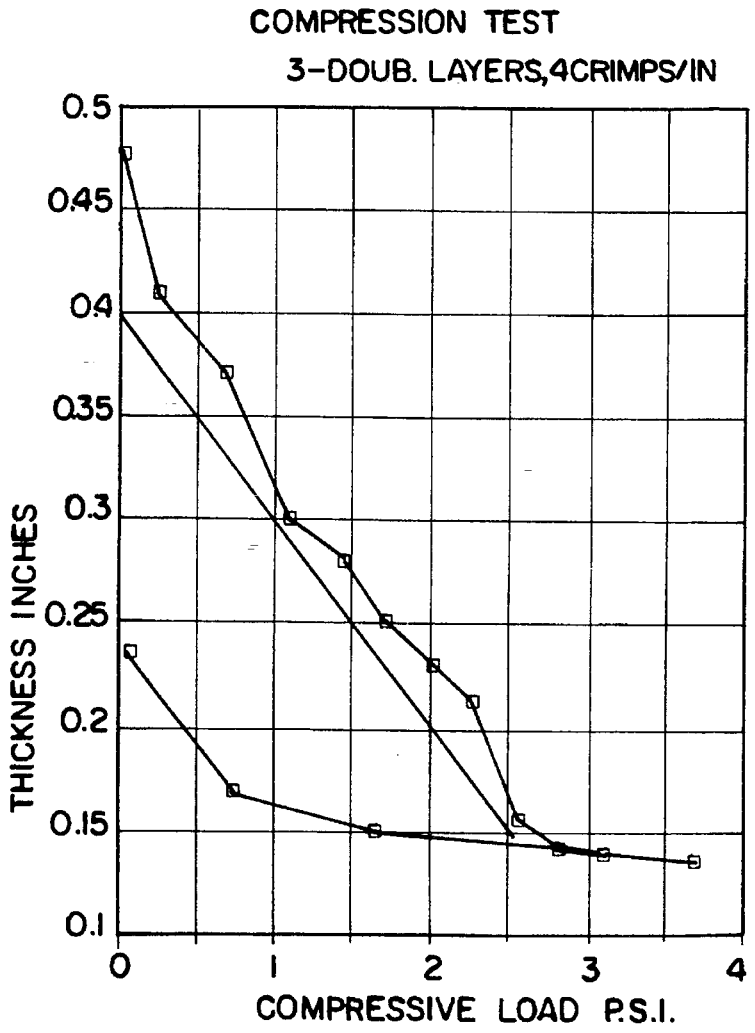
FIGS. 4–8 are graphs of compression tests of various mattresses.
Figure 6:
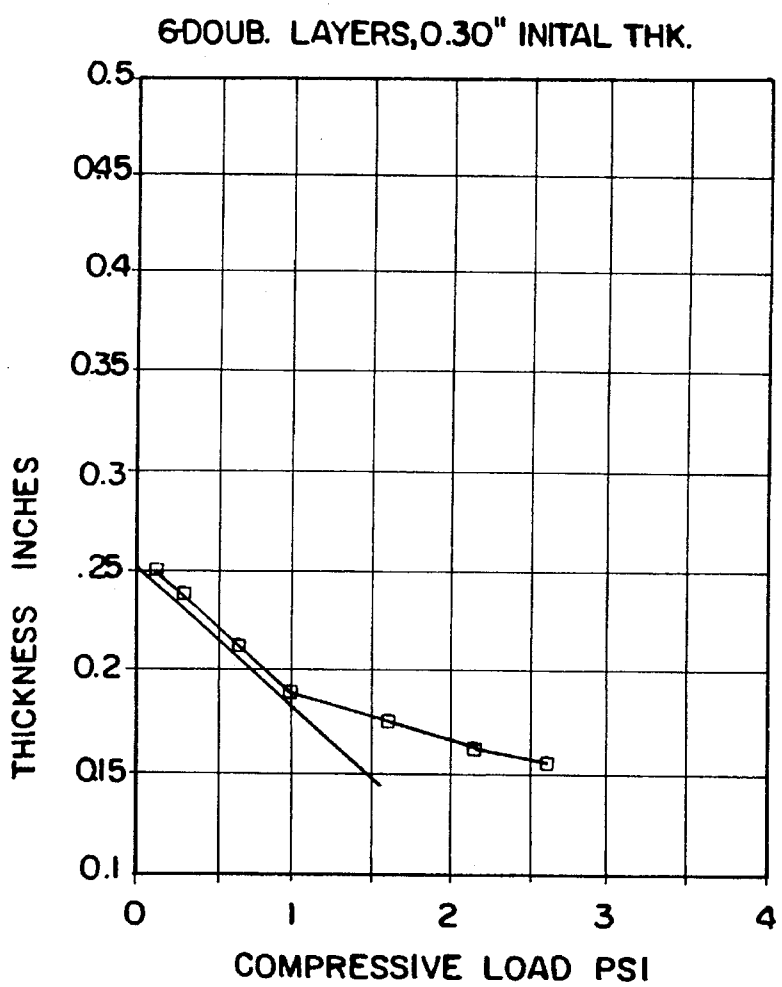
FIG. 6 PRIOR ART
Figure 5:
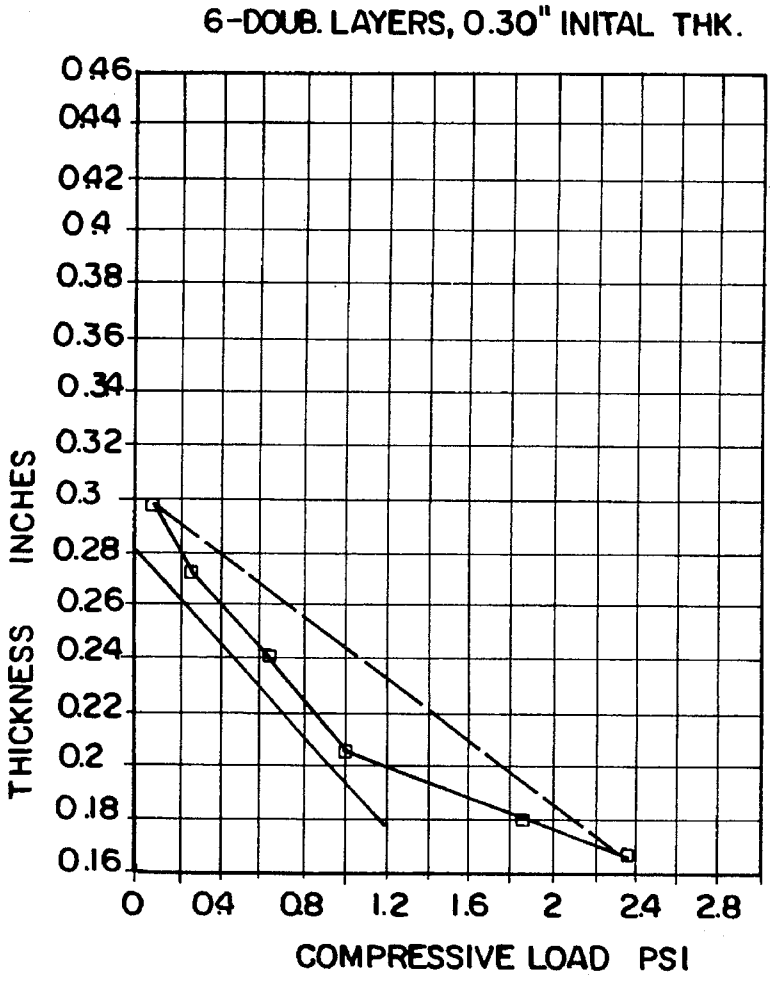
FIG. 5 PRIOR ART
Figure 8:
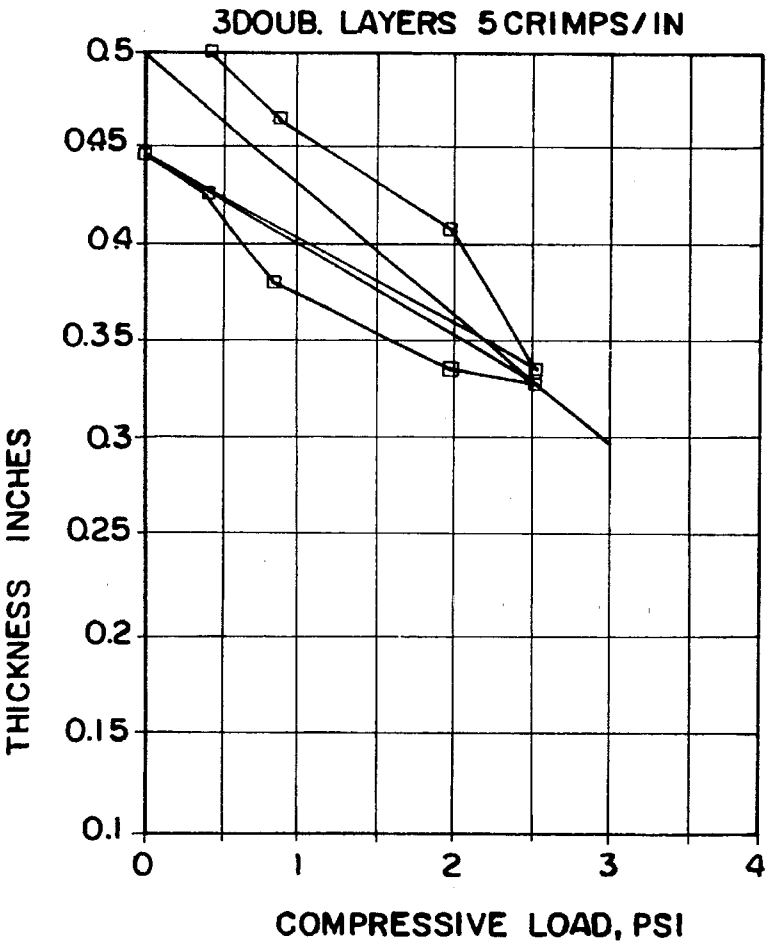
Figure 7:
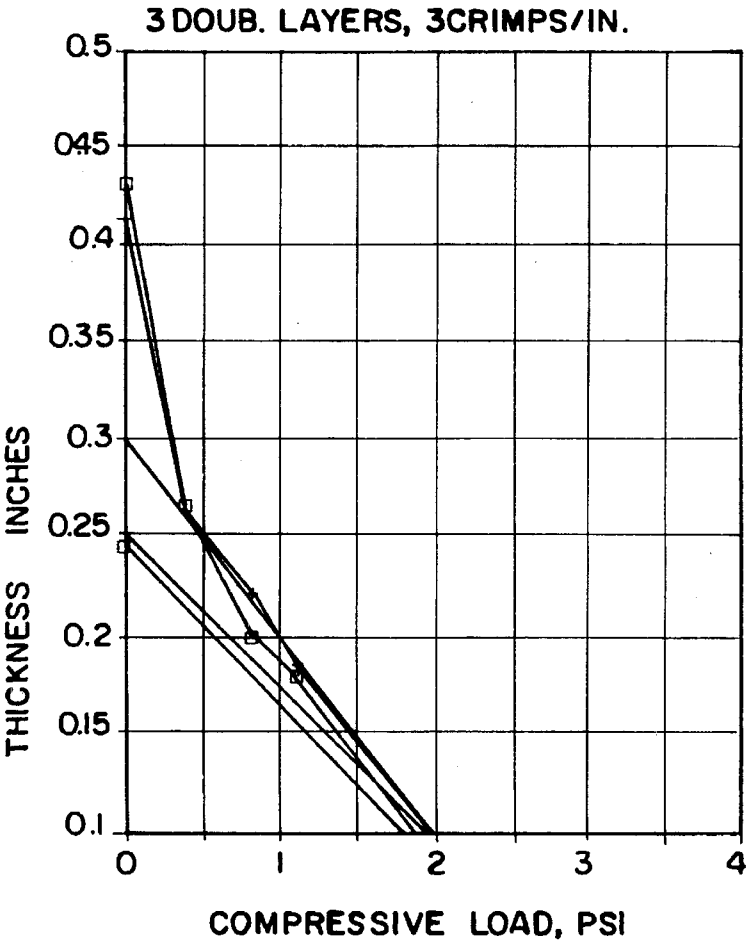

FIG. 3 illustrates a four layered mattress 30 which comprises five non-aligned crimped layers 31,32,33,34,35 and a spiral or helical layer 36. The helical layer 36 is separated from the membrane by the crimped layers to avoid any concentration of forces on the membrane.

In accordance with one embodiment of the invention, the mattress can be prepared by weaving or knitting a wire of a desired metal with a selected diameter into a continuous tube or sock. The tube or sock forms a single double layer mat. The tube or sock is then crimped to provide the desired resilient characteristic. Successive double layers can have a crimp pattern which alternates for example, in a herringbone pattern, so that the crimps are not aligned.

It has been found that there are significant differences in the resiliency of various materials which are obtained during the crimping operation. It has been advantageously found that assembling the layers of the mattress in a non-aligned pattern adds additional thickness and resiliency to the mattress material.

The thickness versus compression curves can be used to select the correct electrode spacing and gasket thickness, while accounting for dimensional tolerances of the cell components. Alternatively, the dimensional tolerances of the cell components can be determined and then a mattress can be selected based on the thickness versus compression curves. The typical average spacing between the face of one electrode to the face of the other electrode in zero-gap cells of the type described in U.S. Pat. No. 4,668,371 is in the range of about 1 to 10 millimeters, but preferably about 3–5 mm. The dimensional variation in the electrode spacing that the mattress materials of this invention can accommodate is from plus or minus 0.0% of the average spacing (i.e., zero dimensional variation) to plus or minus about 50% of the average spacing, when the spacing is greater than about 4 mm, and plus or minus about 25% of the average spacing, when the spacing is less than about 3 mm.

The mattress is specifically chosen so that the compression range lies on that part of the curve that has a large negative slope. This range is selected so that good cell voltage is obtained. Good cell voltage is obtained by having sufficient compressive force on the cell components, from about 0.2–4 psi (pounds force per unit area of electrode in square inches), but not so much compressive force as to cause physical damage to the membrane. The height of the compressed mattress is from about 1.5 to 15 mm, which corresponds to an average electrode spacing of from 2 to 10 mm. As the dimensional variation in electrode to electrode spacing (height) increases, a thicker mattress is preferred. For example: at an electrode spacing of 3.5 mm, the compressed height of the mattress, is from 1.5 to 5.5 mm or plus and minus 25% of the electrode spacing. At an electrode spacing of 6 mm, the mattress materials can accommodate up to about 50% variation in electrode spacing, such that the compressed height of the mattress is from about 3 to 5.5 mm. Additionally, the mattress materials of the present invention must have "resiliency product" (RP) of greater than 100, where:

$$RP=10{,}000\times NS\times CH$$

where RP is the resiliency product in units of $(\text{inches})^2/\text{psi}$, NS is the negative slope of the mattress height versus compressive load curve for a new mattress, and CH is the compressed height over the range that the mattress will be compressed to in the cell in which it is to be used. The slope and RP values for the mattress materials and also for the prior art mattress materials for zero-gap cells can be seen in the following Table I.

TABLE I

| Sample | Crimps/inch | Weight/(area) | Uncomp. thick. in* | Slope in/psi | Value of RP slope × ht |
|---|---|---|---|---|---|
| 1 | 6.5 | 0.133 #/ft$^2$ | 0.20–0.22 | 0.067 | 50 |
| 2 | 3 | 0.56 g/in$^2$ | 0.42–0.46 | 0.10 | 540 |
| 3 | 5 | 0.85 g/in$^2$ | 0.55–0.60 | 0.067 | 116 |
| 4 | | — | 0.47–0.49 | 0.10 | 250 |
| 5 | 6.5 | 0.125 #/ft$^2$ | 0.20–0.22 | 0.083 | 80 |

*uncompressed thickness of new mattress having three double layers, in inches.

The height versus compression curves for these same mattress materials are shown in FIGS. 4–8. Simply doubling the thickness of the mattress does not result in a significant improvement in the RP value of the prior art mattresses, whereas with the mattress materials of the instant invention, RP will be improved as successive alternate layers are used to increase the thickness of the mattress.

The mattress material of construction can be nickel, iron, cobalt, molybdenum, or alloys thereof. The material is selected for good corrosion resistance, good electrical conductivity, and sufficiently low ductility. Preferably, the material is not annealed after fabrication. The crimp pattern is preferably at 45 degrees to the machine direction, but any angle could be used as long as at least two adjacent layers have crimp patterns that do not line up. The preferred number of layers is 6 but from about 6 to 12 double layers could be used. The crimp pattern has a preferred height of from about ⅛ to ¼ inches and a preferred spacing of from 3 to 7 crimps/inches. The preferred wire or fiber thickness used to make the mattress is from about 0.004–0.080 inches in diameter. The preferred crimp pattern in advantageously found among the first six layers adjacent the membrane. Varying the crimp height and the crimp frequency reduces the chances of over compensation in one area.

It is understood that the mattresses or mats of the invention can be used with large size monopolar or bipolar cells. The cells can have ridged electrodes (current leads) or compressible or moveable (non-ridged) electrodes. Preferably, the cathodes is a screen member coated with a $RuO_2$ based coating to give low overvoltage. The cathode could also be expanded sheet material, porous sheet material, electro-formed thin sheet material, all with or without a 10w overvoltage coating for hydrogen or sodium hydroxide production. The cathode could also be a porous electrode bonded to the membrane.

What is claimed:

1. In a pressurized electrolysis cell comprising a cell housing containing at least one pair of electrodes which is a cathode and an anode, a current collector and an ion exchange membrane, the improvement which comprises an electrically conductive, hydraulically permeable resilient mattress substantially coplanar with and contacting on one side the current collector and coplanar with and contacting on the other side an electrode, said mattress comprising at least six layers of woven and crimped metal fibers wherein the crimps of the layers are non-aligned, and having a resiliency product of greater than 100 $(\text{inches})^2/\text{psi}$ according to the formula:

$$RP=10{,}000\times NS\times CH$$

wherein RP represents the resiliency product in $(\text{inches})^2/\text{psi}$, NS is the negative slope of the mattress height versus compressive load of the mattress, and CH is the compressive height over the range that the mattress will be compressed in millimeters.

2. The electrolysis cell of claim 1 wherein said membrane has an area of at least 40 square feet.

3. The electrolysis cell of claim 2 wherein said membrane has an area of about 60 square feet.

4. The electrolysis cell of claim 1 wherein said mattress comprises fibers of a metal selected from the group consisting of nickel, iron, cobalt, molybdenum, lead and alloys thereof.

5. The electrolysis cell of claim 1 wherein the layers of the mattress have an alternating crimp pattern.

6. The electrolysis cell of claim 5 wherein two layers of said mattress are assembled so as to form a herringbone pattern.

7. The electrolysis cell of claim 1 wherein the compressed height of said mattress is from about 1.5 to 5.5 mm, and the average electrode spacing is about 3.5 mm.

8. The electrolysis cell of claim 1 wherein the average electrode spacing is about 4 mm and the compressed height of the mattress is from about 3 to 5.5 mm.

9. The electrolysis cell of claim 1 wherein said mattress comprises from 6 to 12 layers.

10. The electrolysis cell of claim 1 wherein the crimp height of at least two of said mattress layers is from about ⅛ to ¼ inch.

11. The electrolysis cell of claim 1 wherein said mattress layers comprises about 3 to 7 crimps per inch.

12. The electrolysis cell of claim 1 wherein the metal fiber of said layers thickness is about 0.004 to 0.080 inches in diameter.

13. The electrolysis cell of claim 1 which is monopolar.

14. The electrolysis cell of claim 1 which is bipolar.

15. The electrolysis cell of claim 1 which is zero gap.

16. The electrolysis cell of claim 1 including a mattress layer of coiled metal fibers.

* * * * *